US007984771B2

(12) United States Patent
Pabon et al.

(10) Patent No.: US 7,984,771 B2
(45) Date of Patent: Jul. 26, 2011

(54) METHODS AND APPARATUS FOR ATTENUATING DRILLSTRING VIBRATIONS

(75) Inventors: Jahir Pabon, Newton, MA (US); Joachim Sihler, Cheltenham (GB); Demosthenis Pafitis, Cambridge (GB); Chaur-Jian Hsu, Danbury, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 12/887,045

(22) Filed: Sep. 21, 2010

(65) Prior Publication Data

US 2011/0011644 A1 Jan. 20, 2011

Related U.S. Application Data

(62) Division of application No. 11/523,848, filed on Sep. 20, 2006, now Pat. No. 7,828,082.

(51) Int. Cl.
*E21B 7/24* (2006.01)

(52) U.S. Cl. ..... 175/56

(58) Field of Classification Search ..... 175/56, 175/320; 138/114, 149
See application file for complete search history.

(56) References Cited

U.S. PATENT DOCUMENTS 2,984,453 A * 5/1961 Heymann ..... 416/229 R
3,263,446 A 8/1966 Wiggins
3,265,091 A * 8/1966 De Jarnett ..... 138/114
3,842,942 A * 10/1974 Jensen et al. ..... 181/207
3,926,265 A * 12/1975 Bouyoucos ..... 173/80
4,068,742 A 1/1978 Resare
4,086,984 A 5/1978 Johansson
4,133,516 A 1/1979 Jurgens
4,173,130 A 11/1979 Sutliff et al.
4,522,271 A * 6/1985 Bodine et al. ..... 175/56
4,560,012 A * 12/1985 McNeely, Jr. ..... 175/61
4,997,048 A * 3/1991 Isom ..... 175/323
5,365,842 A 11/1994 Panossian
5,833,541 A 11/1998 Turner et al.
6,364,039 B1 * 4/2002 Majkovic ..... 175/320

(Continued)

FOREIGN PATENT DOCUMENTS

WO 2005047640 A2 5/2005

OTHER PUBLICATIONS

Aldred, W.D., et al., Drillstring Vibrations: A New Generation Mechanism and Control Strategies, SPE Annual Technical Conference and Exhibition, Washington, DC, Oct. 1992, pp. 1-11, SPE 24582.

(Continued)

*Primary Examiner* — Daniel P Stephenson
(74) *Attorney, Agent, or Firm* — Brigid Laffey; Helene Raybaud

(57) ABSTRACT

Apparatus and methods are described for highly attenuating vibrations of a drillstring assembly while drilling. In one embodiment, vibrations are attenuated by introducing one or more vibration attenuation modules at appropriate assembly locations. For example, vibration attenuation modules may be inserted at locations where vibration energy is expected to be maximal. In one embodiment the vibration attenuation modules include cavities loosely packed with particles of solid material such as sand or metallic powder. In one embodiment, the cavity walls are rough and/or include geometric features that enhance vibration energy transfer to the loosely packed particles in the cavity(ies). The vibration energy is dissipated via friction and inelastic particle-particle and particle-wall collisions that occur as a result of drillstring motion.

17 Claims, 4 Drawing Sheets

U.S. PATENT DOCUMENTS

| | | | | |
|---|---|---|---|---|
| 6,381,196 | B1 | 4/2002 | Hein et al. | |
| 6,643,221 | B1 * | 11/2003 | Hsu et al. | 367/162 |
| 7,409,758 | B2 * | 8/2008 | Le et al. | 29/421.1 |
| 2008/0315471 | A1 | 12/2008 | Wassell et al. | |

OTHER PUBLICATIONS

Alley, S.D., et al., The Use of Real-Time Downhole Shock Measurements to Improve BHA Component Reliability, SPE Annual Technical Conference and Exhibition, Dallas, TX, Oct. 1991, pp. 1-6, SPE22537.

Chen, D. C.-K., et al., Integrated Drilling Dynamics System Closes the Model-Measure-Optimize Loop in Real Time, SPE/IADC Drilling Conference, The Netherlands, Feb. 2003, pp. 1-12, SPE/IADC79888.

Clayer, F., et al., The Effect of Surface Downhole Boundary Conditions on the Vibration of Drillstrings, SPE Annual Technical Conference and Exhibition, Sep. 1990, New Orleans, LA, pp. 1-12,SPE 20447.

Cobern, M. E., et al., Drilling Vibration Monitoring & Control System, APS Technology, Inc., Technical Report, Oct. 2004, from http://www.aps-tech.com/news/publications/APS-DVMCS.pdf.

Dykstra, M.W., et al., Drillstring Component Mass Imbalance: A Major Source of Downhole Vibrations, SPE Drilling & Completition, Dec. 1996, pp. 234-241, vol. 11, No. 4, SPE29350-PA.

Halsey, G.W., et al., Torque Feedback Used to Cure Slip-Stick Motion, SPE Annual Technical Conference and Exhibition, Houston, TX, Oct. 1998, pp. 1-6, 18049-MS.

Hollkamp, J. J., et al., Experiments with Particle Damping, Proceedings of SPIE, Smart Structures and Materials 1998: Passive Damping and Isolation, Jun. 1998, pp. 2-12, vol. 3327.

Jardine, S., et al., Putting a Damper on Drilling's Bad Vibrations, Oilfield Review, Schlumberger, Jan. 1994, pp. 15-20.

Lesso, W. G., Jr., et al., Quantifying Bottomhole Assembly Tendency Using Field Directional Drilling Data and a Finite Element Model, SPE/IADC Drilling Conference, Mar. 1999, Holland, pp. 1-16, SPE/IADC 52835.

Mao, K., et al., Simulation and Characterization of Particle Damping in Transient Vibrations, Transaction of the ASME, Apr. 2004, pp. 202-211, vol. 126.

Panossian, H. V., Structural Damping Enhancements Via Non-obstructive Particle Damping Technique, Journal of Vibration and Acoustics, Jan. 1992, pp. 101-105, vol. 114.

Panossian, H., Non-Obstructive Particle Damping Experience and Capabilities, Engineering Papers, The Boeing Company, Oct. 2004 from http://www.engineeringatboeing.com/datasources/Non-ObstructiveParticleDampingExperienceAndCapabilities.doc.

Rabia, H., Oilwell Drilling Engineering: Principles and Practice,1985, pp. 17-47 and 147-171, Graham & Trotman, UK.

Tucker R. W., et al., An Integrated Model for Drill-String Dynamics, Journal of Sound and Vibration, 1999, pp. 123-165, vol. 224, No. 1.

APS Technology, Inc., Vibration Isolation Sub Technical Data Sheet, APS Technology, Inc., Oct. 2004, from http://www.aps-tech.com/tds/APS-VibrationIsoSub-s.pdf.

* cited by examiner

METHODS AND APPARATUS FOR ATTENUATING DRILLSTRING VIBRATIONS

CROSS REFERENCE TO RELATED APPLICATIONS

This patent application is a divisional application from U.S. patent application Ser. No. 11/523,848 filed Sep. 20, 2006, which is incorporated by reference herein in its entirety.

FIELD

The present specification generally describes methods and apparatus associated with drilling through subsurface formations. More particularly, the present specification describes principles for improving drilling operations and extending the life of drillstring assemblies by attenuating drillstring vibrations.

BACKGROUND

It is well known that during well drilling operations, drillstring assemblies can undergo potentially damaging vibrations. Axial (e.g. bit bounce), torsional (e.g. stick-slip), and lateral (e.g. flexing, whirling) vibrations are well known phenomena that can damage drilling assemblies. See Jardine S., Malone, D., and Sheppard, M., "*Putting a damper on drilling's bad vibrations*," THE OILFIELD REVIEW, Schlumberger, January 1994. Extensive study and engineering has been done over the years to better understand, monitor, and control these potentially damaging drillstring vibrations. See Rabia, H., "*Oilwell drilling engineering principles and practice*," Graham & Trotman, 1985; Clayer, F., Vandiver, J. K., and Lee, H. Y., "*The effect of surface and downhole boundary conditions on the vibration of drillstrings*," PROCEEDINGS 65 ANNUAL TECH. CONF. SPE, New Orleans, SPE 20447 1990; Tucker, R. W. and Wang, C., "*An integrated model for drillstring dynamics*," Lancaster University, 2000; Dykstra, M. W., Chen, D. C., Warren, T. M., and Azar, J. J., "*Drillstring component mass imbalance: A major source of downhole vibrations*," SPE DRILLING AND COMPLETIONS, December 1996; Lesso W. G. Jr., Chau, M. T., and Lesso, W. G. Sr., "*Quantifying bottomhole assembly tendency using field directional drilling data and finite element model*," SPE/IADC 52835, 1999.

Downhole monitoring and surface control techniques have been proposed to deal with some of the vibrations mentioned above. See Halsey G. W., Kyllingstad, A., and Kylling, A., "*Torque feedback used to cure slip-stick motion*," SPE 18049, 1988; Alley, S. D. and Sutherland, G. B., "*The use of real-time downhole shock measurements to improve BHA component reliability*," SPE 22537 1991; Aldred, W. D., and Sheppard, M. C., "*Drillstring vibrations: A new generation mechanism and control strategies*," SPE 24582 1992; Chen, D. C-K., Smith, M., and LaPierre, S., "*Integrated drilling dynamics system closes the model-measure-optimize loop in real time*," SPE/IADC 79888. However, it has become clear that in-situ damping of the vibrations would have a greater impact on limiting the extent of damage caused by the vibrations the drillstring is subjected to.

Accordingly, some have proposed in-situ damping techniques, although each has its limitations. APS Technology suggests use of an isolation sub, which includes two loosely threaded cylindrical members with rubber molded into the threaded cavity. The rubber between threaded cylindrical members is intended to damp the drilling induced vibrations. Nevertheless, the temperature-dependent properties of rubber, inter alia, make it difficult or impossible to obtain reliable performance across different drilling conditions. In addition, the huge torque and axial loads common to drilling operations must be transmitted through the rubber damping material, which is difficult. Cobern and Wassell propose a modified sub in which a magnetorheological fluid filling a narrow gap between two components of the drillstring assembly is used as the damping mechanism. Cobern, M. E., and Wassell, M. E., "*Drilling vibration monitoring and control system*," APS TECHNOLOGY INC. TECH. REPORT APS-DVMCS, 2004. The viscosity of the fluid is regulated by a magnetic circuit to tune the damping under different drilling conditions. It is not clear, however, that this proposal will be effective.

The present specification is directed to overcoming, or at least reducing the effects of, one or more of the problems outlined above.

SUMMARY OF THE INVENTION

The present disclosure addresses at least some of the above-described needs and others. Specifically, the present disclosure describes many methods and apparatus for attenuating vibrations of a drillstring assembly while drilling. In one embodiment, vibrations are attenuated by introducing one or more vibration attenuation modules at appropriate assembly locations. For example, vibration attenuation modules may be inserted at locations where vibration energy is expected to be maximal. In one embodiment, the vibration attenuation modules include one or more cavities loosely packed with particles of solid material such as sand or metallic powder, which may be of high density, such as tungsten or similar heavy metal powder. In one embodiment, the cavity walls are roughened and/or include geometric features that enhance vibration energy transfer to the loosely packed particles in the cavity(ies). The vibration energy is dissipated via friction and inelastic particle-particle and particle-wall collisions that occur as a result of drillstring motion.

One embodiment provides an apparatus comprising an oilfield drillstring vibration attenuation module. The oilfield drillstring vibration attenuation module comprises a mandrel. The mandrel comprises an outer surface and an inner surface, the inner surface defining a passageway through the mandrel, an annular cavity between the inner and outer surfaces, and particles packed in the annular cavity. In one embodiment, the mandrel comprises first and second threaded ends configured for insertion between adjacent drill pipes. In one embodiment, the mandrel comprises a first pipe, and a second pipe threadedly attached to and disposed at least partially inside of the first pipe. The annular cavity may be disposed between the first and second pipes. In one embodiment of the apparatus, the mandrel comprises a first pipe, and a second pipe threadedly attached to and concentric with the first pipe, such that the annular cavity is disposed between the first and second pipes.

In one embodiment, the mandrel comprises a stabilizer ring configured for attachment about a drillstring. In one embodiment, the stabilizer ring is attached around a collar. The stabilizer ring may include a plurality of protruding blades, and the blades may comprise the annular cavity (each packed with the particles).

In one embodiment of the apparatus, the cavity comprises an internal wall having features that enhance transfer of vibration energy from the internal wall to the particles. In one embodiment, the internal wall features comprise a spiral. In another embodiment, the internal wall features comprise a plurality of grooves and protrusions that increase particle/wall collisions. In one embodiment, the internal wall features comprise a roughened surface.

One embodiment provides an apparatus comprising an oilfield drillstring. The drillstring comprises at least one vibration attenuation module, and the at least one vibration attenuation module comprises concentric pipes, a cavity formed between the concentric pipes, and particles packed in the cavity. In one embodiment, the cavity comprises internal wall features that enhance transfer of vibration energy from the drillstring to the particles. In one embodiment, the internal wall features are geometrically shaped to facilitate transfer of axial, lateral, and torsional vibration energy from the internal wall to the particles. In one embodiment, the internal wall features comprise a spiral. In one embodiment, the internal wall features comprise a plurality of grooves and protrusions that increase particle/wall collisions. In one embodiment, the internal wall features comprise a zig-zag pattern and a roughened surface. In one embodiment, the particles are loosely packed in the cavity. In one embodiment, the particles are solid. Some embodiments further comprise a plurality of vibration attenuation modules. In one embodiment, each of the plurality of vibration attenuation modules is placed at anticipated maximum vibration locations of the drillstring.

One embodiment provides an oilfield apparatus comprising a drillstring. The drillstring comprises drill pipe and a bottomhole assembly. The bottom hole assembly comprises concentric cylinders and an annular cavity, and particles of solid material loosely packed in the annular cavity.

One embodiment provides an apparatus comprising an oilfield drillstring, the drillstring comprising at least one vibration attenuation module. The at least one vibration attenuation module comprises a stabilizer ring including a plurality of hollow blades arranged around a collar, where at least one of the hollow blades is loosely packed with particles. In one embodiment, each of the hollow blades is loosely packed with particles.

One aspect provides a method comprising attenuating drilling induced vibrations in an oilfield drillstring. The attenuating comprises inserting at least one particle-damping-based vibration attenuation module at one or more locations of the drillstring, and absorbing vibrational energy with the at least one vibration attenuation module. In one aspect, the method further comprises strategically inserting multiple vibration attenuation modules along the drillstring to reduce vibration. One aspect further comprises inserting multiple vibration attenuation modules along the drillstring at locations where vibrational energy is expected to be maximal.

Additional advantages and novel features will be set forth in the description which follows or may be learned by those skilled in the art through reading these materials or practicing the principles described herein.

BRIEF DESCRIPTION OF THE DRAWINGS

The accompanying drawings illustrate certain embodiments and are a part of the specification.

Figure 1:
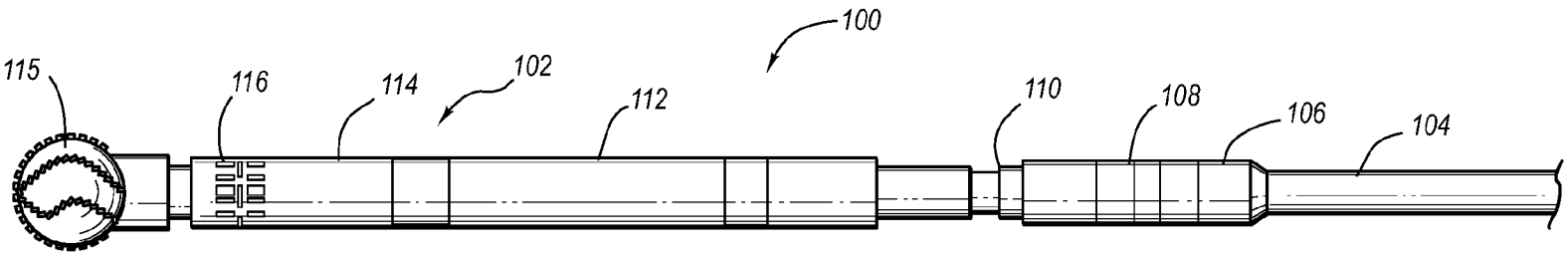
FIG. 1 is a front view of a drilling tool that may be used with at least one vibration attenuation module according to one embodiment.

Throughout the drawings, identical reference characters and descriptions indicate similar, but not necessarily identical elements. While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION

Illustrative embodiments and aspects of the invention are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present invention. Thus, the appearance of the phrases "in one embodiment" or "in an embodiment" or "in some embodiments" (or "aspects") in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment of this invention.

The present disclosure contemplates, among other things, methods and apparatus for attenuating vibrations of a drillstring assembly while drilling. In some embodiments, vibrations are attenuated by introducing one or more vibration attenuation modules at appropriate assembly locations. For example, vibration attenuation modules may be inserted at locations where vibration energy is expected to be high or maximal. In some embodiments, the vibration attenuation modules include one or more cavities loosely packed with particles material that may be solid, such as sand or metallic powder. In some embodiments, the solid particles of material comprise a high density material, such as tungsten or a similar heavy metal powder. In some embodiments, the particles are generally round (spherical) and comprise diameters ranging between a few microns and a few millimeters. However, any other particle size may also be used. Vibration energy is dissipated via friction and inelastic particle-particle and particle-wall collisions that occur as a result of drillstring motion. Dissipation of vibration energy by friction and inelastic particle-particle and particle-wall collisions is referred to as particle damping.

Generally speaking, particle damping refers to structural damping and involves the use of particle-filled enclosures as part of the vibrating structure, which is described, for example, in U.S. Pat. No. 5,365,842 to Panossian and which is incorporated in its entirety by this reference. The cavities are generally loosely packed with granular materials (sand, metallic powder, etc.) that absorb kinetic energy by particle-particle and particle-wall collisions.

There has been at least one application of particle damping applied to the attenuation of acoustic vibrations in logging tools. See U.S. Pat. No. 6,643,221, which is hereby incorporated in its entirety by this reference. Proposed patterns of small holes and grooves machined on collars are filled with heavy particles. However, the high frequency (typically above 3 kHz) and small amplitude (typically less than one micron) nature of the acoustic vibrations the device was intended to attenuate have made it difficult or impossible for the proposed damping to be successful.

However, the inventors discovered that drilling induced vibrations are typically much lower in frequency (usually below 100 Hz), and can exhibit large amplitudes (e.g., a drillstring impacting a borehole wall), for which particle damping may be well suited.

Turning now to the drawings, and, in particular, FIG. 1, a drillstring 100 is shown. According to the embodiment of FIG. 1, the drillstring 100 includes a bottomhole assembly 102 and drillpipe 104. The bottomhole assembly 102 may include a connector 106 to the drillpipe 104 and a check valve assembly 108. Downhole of the check valve assembly 108 may be a pressure disconnect 110. If the drillstring 100 is capable of directional drilling, the drillstring will include an orienting tool 112 which is known by one of ordinary skill in the art having the benefit of this disclosure. In some cases, the entire drillstring 100 rotates and causes rotation of a drill bit 115 to facilitate borehole drilling. However, some systems may include a mud motor 114 to drive and rotate a drill bit 115 and an adjustable bent housing 116 facilitates directional drilling. According to principles described herein, vibration attenuation of the drillstring 100 may be especially effective when the entire drillstring 110 fully rotates without any need for a mud motor or adjustable bent housing. Some embodiments may not include acoustic logging equipment, although the principles described herein are equally applicable to attenuating low frequency vibrations in drillstrings that make measurements while drilling.

Figure 2:
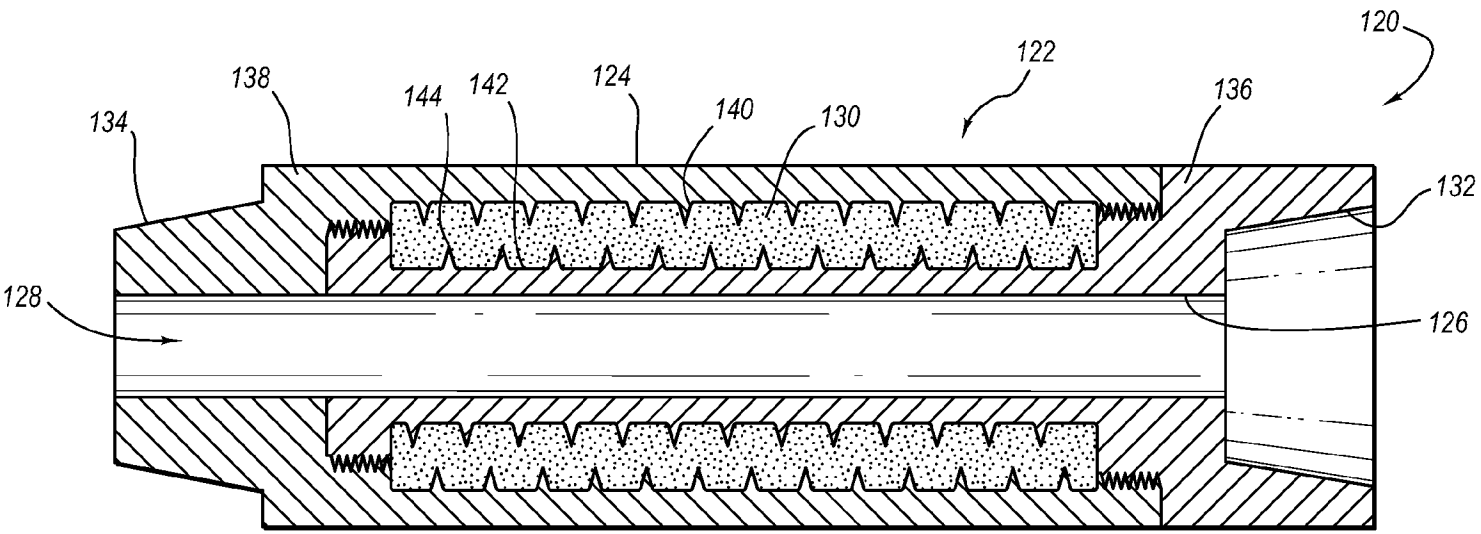
FIG. 2 is a longitudinal cross-sectional view of one vibration attenuation stage that may be used with the tool shown in FIG. 1 (or others) according to one embodiment.

As mentioned above, drilling operations with a drillstring such as the drillstring 100 shown in FIG. 1 generate heavy vibrations that reduce the life of the drilling tools. Therefore, one embodiment shown in FIG. 2 provides an apparatus comprising an oilfield drillstring vibration attenuation module 120. One or more of the oilfield drillstring vibration attenuation modules 120 may be inserted into the drillstring 100 (FIG. 1). The oilfield drillstring vibration attenuation module 120 comprises a mandrel 122. The mandrel 122 comprises an outer surface 124 and an inner surface 126. The inner surface 126 defines a passageway 128 through the mandrel 122 that allows drilling mud and other fluids to communicate therethrough between segments of drillpipe and/or other drillstring components. An annular cavity 130 is formed between the inner and outer surfaces 124, 126, and particles are packed in the annular cavity 130. In one embodiment, the particles are loosely packed in the annular cavity 130 to facilitate vibration attenuation. Volume of the annular cavity 130 may be maximized in some aspects to increase the amount of energy that can be absorbed. Maximizing the volume of the annular cavity 130 may require consideration of mechanical and mud flow constraints inherent to the drilling operations.

In the embodiment of FIG. 2, the mandrel 122 comprises first and second ends 132, 134 that are preferably, but not necessarily, threaded. The first and second ends 132, 134 allow the vibration attenuation module 120 to be inserted: between adjacent segments of drillpipe 104 (FIG. 1), between components of the bottomhole assembly 102 (FIG. 1), between a segment of drillpipe and the bottomhole assembly, or between other components.

Although the mandrel 122 may comprise a single piece, in one embodiment, the mandrel 122 comprises a first pipe 136, and a second pipe 138 threadedly attached to and disposed at least partially inside of the first pipe 136. The annular cavity 130 may be disposed between the first and second pipes 136, 138. In the embodiment shown in FIG. 2, the first pipe 136 is a cylindrical pipe, and the second pipe 138 is also cylindrical and threadedly attached to (and concentric with) the first pipe 136.

According to some aspects, the annular cavity 130 comprises an internal wall 140 that includes features that enhance the transfer of vibrational energy from the internal wall 140 to the particles. In some embodiments, the internal wall features are geometrically shaped to facilitate transfer of axial, lateral, and torsional vibration energy from the internal wall 140 to the particles. For example, the internal wall features may comprise a spiral. In another embodiment, the internal wall features comprise a plurality of grooves 142 and protrusions 144 that increase particle/wall collisions. The grooves 142 and protrusions 144 may be arranged in the spiral or zig-zag pattern shown in FIG. 2. In one embodiment, the internal wall 140 comprises a roughened surface that also facilitates wall/particle interactions. Pre-modeling may allow designing the internal wall features in a way that allows for the best tradeoff between damping in the different vibrational modes (axial, lateral, torsional) to achieve maximum overall performance.

Some embodiments include two or more vibration attenuation modules 120 spaced along the drillstring 100 (FIG. 1). Some embodiments may include three to ten vibration attenuation modules. In one embodiment, each of the vibration attenuation modules 120 is placed at anticipated maximum vibration locations of the drillstring 100 (FIG. 1). Those of ordinary skill in the art having the benefit of this disclosure will recognize that a pre-plan drill modeling study and/or experimentation will yield the likely locations of maximum vibration.

Figure 3B:
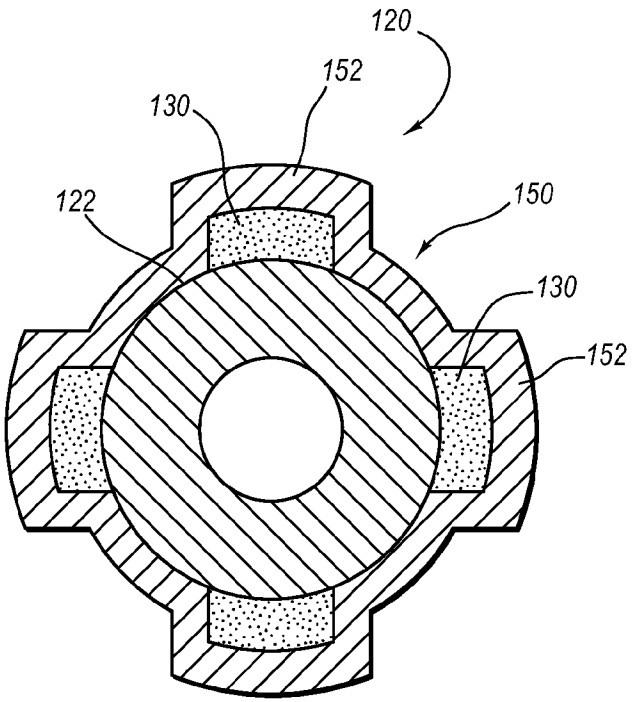
FIG. 3B is top cross-sectional view of the vibration attenuation stage of FIG. 3A according to one embodiment.
Figure 3A:
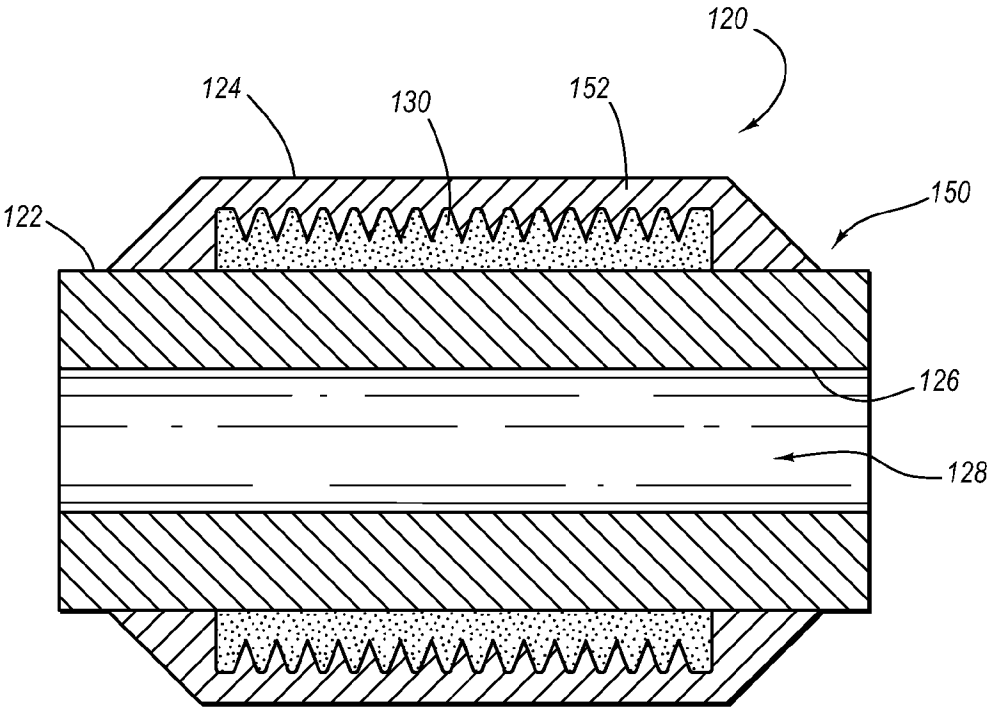
FIG. 3A is a longitudinal cross-sectional view of one vibration attenuation stage that may be used with the tool shown in FIG. 1 (or others) according to another embodiment.

In one embodiment, the mandrel 122 comprises a stabilizer ring 150 shown in FIGS. 3A-3B. The stabilizer ring 150 of FIGS. 3A-3B may be configured for attachment about the drillstring 100 (FIG. 1). In one embodiment, the stabilizer ring 150 is attached around a collar of the drillstring 100 (FIG. 1), but other locations may also be used. The stabilizer ring 150 may include a plurality of radially protruding blades, for example the four equally spaced hollow blades 152 shown in FIGS. 3A-3B. However, any number of blades may be used. The interior of the blades 152 comprises the annular cavity 130, although the annular cavities 130 of FIGS. 3A-3B are discontinuous circumferentially. Each of the annular cavities 130 of FIGS. 3A-3B may be loosely packed with the same particles described above with reference to FIG. 2. Particle damping at drillstring stabilizers (such as stabilizer rings 150) may significantly increase the life of the drillstring 100 (FIG. 1) by absorbing much of the shock and vibration induced by drilling with the particles.

Figure 4:
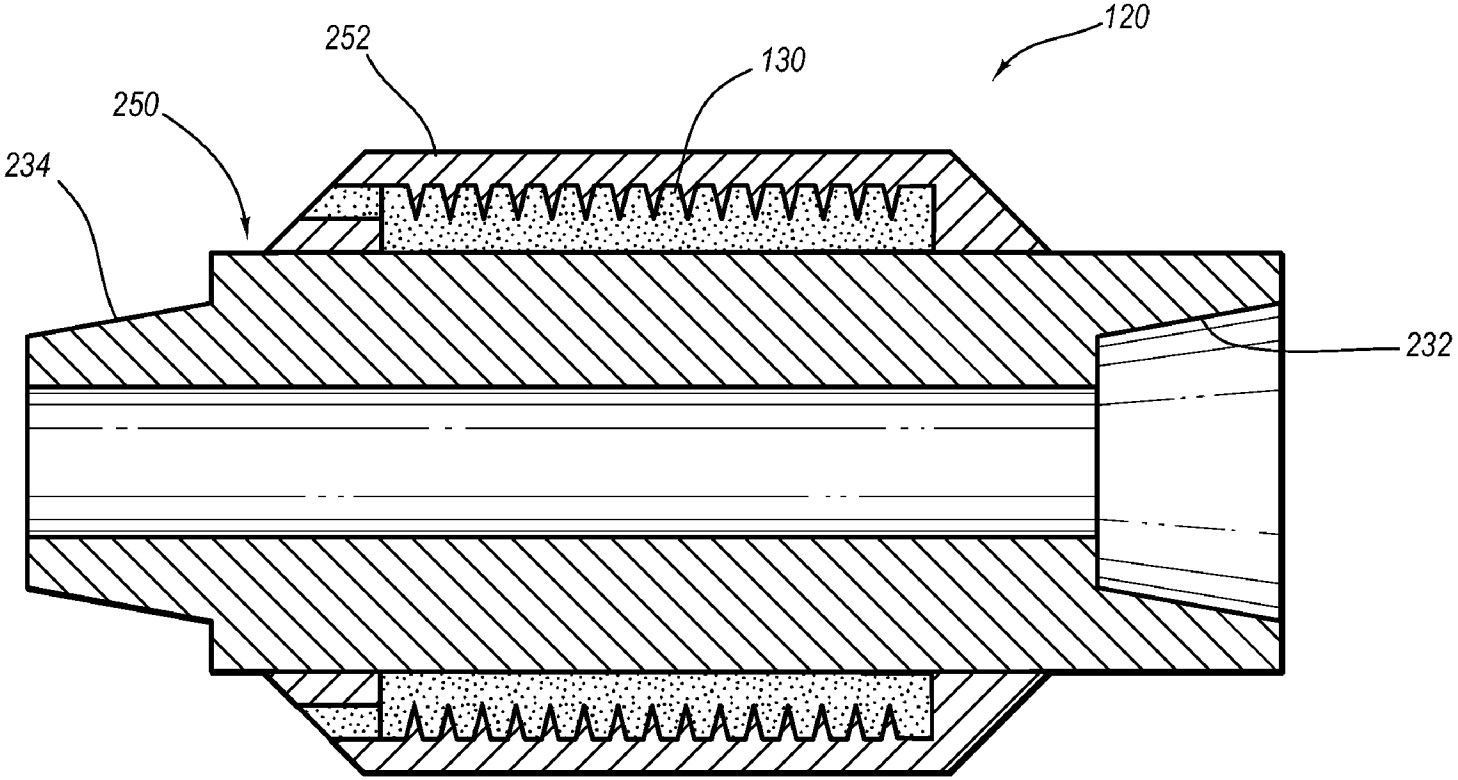
FIG. 4 is a cross-sectional view of one vibration attenuation stage that may be used with a drilling tool according to another embodiment.

Although the vibration attenuation module 120 comprising the stabilizer ring 150 shown in FIGS. 3A-3B may be attached around the drillstring 100 (FIG. 1) as described above, other embodiments may comprise separate modules. For example, FIG. 4 illustrates a vibration attenuating module 120 comprising an insertable stabilizer 250. Similar to the embodiment of FIG. 2, the insertable stabilizer 250 may comprise first and second ends 232, 234 that are preferably, but not necessarily, threaded. The first and second threaded ends 232, 234 allow the vibration attenuation module 120 to be inserted: between adjacent segments of drillpipe 104 (FIG. 1), between components of the bottomhole assembly 102 (FIG. 1), between a segment of drillpipe and the bottomhole assembly, or between other components.

Figure 5:
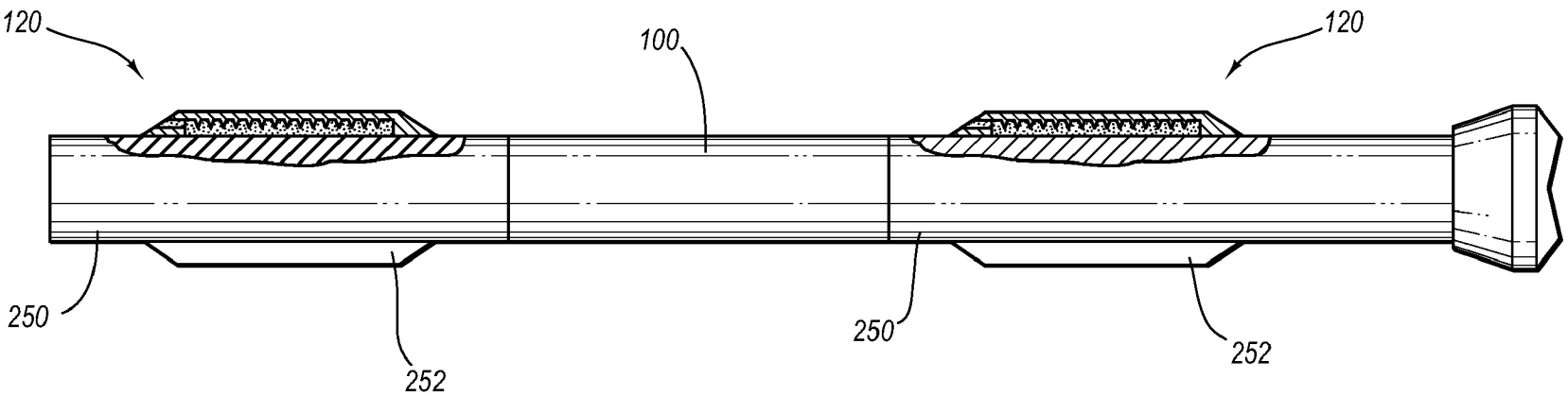
FIG. 5 is a front view, partly in section, showing two of the vibration attenuation stages of FIG. 4 in place on a drilling tool.

Like the stabilizer ring 150 (FIGS. 3A-3B), the insertable stabilizer 250 may include a plurality of radially protruding blades, for example four equally spaced hollow blades 252 shown in FIGS. 4-5. However, any number of blades may be used. The interior of the blades 252 comprises the annular cavity 130. Each of the annular cavities 130 of FIGS. 4-5 may be loosely packed with the same particles described above with reference to FIG. 2. Although two vibration attenuation modules 120 are illustrated in FIG. 5, any number of attenuation modules 120 comprising the insertable stabilizers 250 may be inserted into the drillstring 100. As mentioned above, particle damping at drillstring stabilizers (such as insertable stabilizers 250) may significantly increase the life of the drillstring 100 by absorbing much of the shock and vibration induced by drilling with the particles.

Each apparatus shown and described above may be used with any drillstring and is not limited to the embodiments shown in FIGS. 1 and 5. Moreover, the present specification contemplates any drillstring particle damping and is not limited to the specific embodiments shown in FIGS. 1-5. One aspect contemplates a method comprising attenuating drilling induced vibrations in an oilfield drillstring. The attenuating comprises inserting at least one particle-damping-based vibration attenuation module (such as those described above) at one or more locations of the drillstring, and absorbing vibrational energy with the at least one vibration attenuation module. In one aspect, the method further comprises strategically inserting multiple vibration attenuation modules along the drillstring to reduce drilling-induced vibration. One aspect further comprises inserting multiple vibration attenuation modules along the drillstring at locations where vibrational energy is expected to be larger or maximal.

The preceding description has been presented only to illustrate and describe certain principles. It is not intended to be exhaustive or to limit the invention to any precise form disclosed. Many modifications and variations are possible in light of the above teaching.

The embodiments shown and described were chosen and described in order to best explain the principles of the invention and its practical application. The preceding description is intended to enable others skilled in the art to best utilize the principles taught in various embodiments and with various modifications as are suited to the particular use contemplated. It is intended that the scope of this disclosure be defined by the following claims.

What is claimed is:

1. An apparatus, comprising;

an oilfield drillstring vibration attenuation module, the oilfield drillstring vibration attenuation module comprising:

a mandrel, the mandrel comprising:

an outer surface and an inner surface;

the inner surface defining a passageway through the mandrel;

a cavity between the inner and outer surfaces;

particles packed in the cavity; and wherein the cavity comprises internal surface area enhancing geometric wall features that enhance transfer of vibration energy from the drillstring to the particles.

2. An apparatus according to claim 1, wherein the mandrel comprises first and second threaded ends configured for insertion between adjacent drill pipes.

3. An apparatus according to claim 1, wherein the mandrel comprises:

a first pipe;

a second pipe threadedly attached to and disposed at least partially inside of the first pipe;

wherein the cavity is disposed between the first and second pipes.

4. An apparatus according to claim 1, wherein the mandrel comprises:

a first pipe;

a second pipe threadedly attached to and concentric with the first pipe;

wherein the cavity is disposed between the first and second pipes.

5. An apparatus according to claim 1, wherein the mandrel comprises an insertable stabilizer configured for modular placement in a drillstring.

6. An apparatus according to claim 5, wherein the insertable stabilizer comprises a plurality of protruding blades, wherein the blades comprise the cavity and each is packed with the particles.

7. An apparatus according to claim 1, wherein the mandrel comprises a stabilizer ring configured for attachment about a drillstring.

8. An apparatus according to claim 7, wherein the stabilizer ring is attached around a collar.

9. An apparatus according to claim 7, wherein the stabilizer ring comprises a plurality of protruding blades, wherein the blades comprise the cavity and each is packed with the particles.

10. An apparatus according to claim 1, wherein the cavity comprises an internal wall having features that enhance transfer of vibration energy from the internal wall to the particles.

11. An apparatus according to claim 10, wherein the internal wall features comprise a spiral.

12. An apparatus according to claim 10, wherein the internal wall features comprise a plurality of grooves and protrusions that increase particle/wall collisions.

13. An apparatus according to claim 10, wherein the internal wall features comprise a roughened surface.

14. A oilfield apparatus, comprising:

a drillstring, the drillstring comprising:

drill pipe;

a bottomhole assembly, the bottomhole assembly comprising:

concentric cylinders and a cavity;

particles of solid material loosely packed in the cavity; and wherein the cavity comprises internal surface area enhancing geometric wall features that enhance transfer of vibration energy from the drillstring to the particles.

15. A method, comprising:

attenuating drilling induced vibrations in an oilfield drillstring, the attenuating comprising:

inserting at least one vibration attenuation module at one or more locations of the drillstring, the at least one vibration attenuation module comprising a cavity with internal surface area enhancing geometric wall features that enhance transfer of vibration energy from the drillstring to the particles;

absorbing vibrational energy with the at least one vibration attenuation module.

16. A method according to claim 15, further comprising strategically inserting multiple vibration attenuation modules along the drillstring to reduce vibration.

17. A method according to claim 15, further comprising inserting multiple vibration attenuation modules along the drillstring at locations where vibrational energy is expected to be maximal.

* * * * *